US007540239B2

(12) United States Patent
Baintner et al.

(10) Patent No.: US 7,540,239 B2
(45) Date of Patent: Jun. 2, 2009

(54) WEB-FED ROTARY PRINTING UNIT

(75) Inventors: Alfons Baintner, Aystetten (DE); Karl-Heinz Bienert, Edenhausen (DE); Norbert Dylla, Stadtbergen (DE); Max Eder, Mering (DE)

(73) Assignee: manroland AG, Offenbach am Main (DE)

( * ) Notice: Subject to any disclaimer, the term of this patent is extended or adjusted under 35 U.S.C. 154(b) by 0 days.

(21) Appl. No.: 11/180,173

(22) Filed: Jul. 13, 2005

(65) Prior Publication Data

US 2006/0016357 A1 Jan. 26, 2006

(30) Foreign Application Priority Data

Jul. 13, 2004 (DE) ..... 10 2004 034 050

(51) Int. Cl.
*B41F 33/00* (2006.01)
*B41F 7/00* (2006.01)
*B41F 13/00* (2006.01)

(52) U.S. Cl. ..... 101/174; 101/171; 101/178; 101/181; 101/183

(58) Field of Classification Search ..... 101/480, 101/492, 177, 183, 217, 247, 216, 180, 220, 101/218, 142, 181; *B41F 33/00*
See application file for complete search history.

(56) References Cited

U.S. PATENT DOCUMENTS 3,963,902 A * 6/1976 Dowd ..... 377/17
4,350,093 A * 9/1982 Ishii ..... 101/217
4,405,884 A 9/1983 Weber ..... 318/85
4,694,749 A * 9/1987 Takeuchi et al. ..... 101/492
4,753,168 A * 6/1988 Theilacker et al. ..... 101/177
5,117,753 A * 6/1992 Mamberer ..... 101/225
5,309,834 A * 5/1994 Koch ..... 101/248
5,331,890 A * 7/1994 Miyoshi et al. ..... 101/177
5,615,609 A * 4/1997 Hill et al. ..... 101/183
5,640,906 A * 6/1997 Schmitt ..... 101/177
5,771,804 A * 6/1998 Knauer et al. ..... 101/183
5,782,182 A * 7/1998 Ruckmann et al. ..... 101/177
5,787,806 A * 8/1998 Seyfried ..... 101/181
5,826,505 A * 10/1998 Volz et al. ..... 101/183
5,901,647 A * 5/1999 Kohlmann ..... 101/216
5,950,538 A * 9/1999 Puschnerat ..... 101/217
5,970,870 A * 10/1999 Shiba et al. ..... 101/137

(Continued)

FOREIGN PATENT DOCUMENTS

DE 432854 C 8/1926

(Continued)

*Primary Examiner*—Jill E Culler
*Assistant Examiner*—'Wyn' Q Ha
(74) *Attorney, Agent, or Firm*—Leydig, Voit & Mayer, Ltd.

(57) ABSTRACT

A web fed rotary printing unit is provided. The printing unit includes a plurality of cylinders including a first cylinder assigned a first adjustable drive motor and a second cylinder assigned a second adjustable drive motor. The first and second cylinders are in a mechanical drive connection that can be moved between engaged and disengaged positions. When the mechanical drive connection is engaged, the first drive motor assigned to the first cylinder forms a master drive in dependence on which the second drive motor assigned to the second cylinder can be controlled in the manner of a slave drive.

11 Claims, 7 Drawing Sheets

U.S. PATENT DOCUMENTS

| | | | | |
|---|---|---|---|---|
| 5,970,871 | A * | 10/1999 | Andres | 101/180 |
| 5,988,063 | A * | 11/1999 | Brandenburg et al. | 101/219 |
| 6,019,039 | A * | 2/2000 | Knauer et al. | 101/218 |
| 6,032,579 | A * | 3/2000 | Richards | 101/219 |
| 6,050,185 | A * | 4/2000 | Richards | 101/142 |
| 6,186,064 | B1 * | 2/2001 | Dufour | 101/181 |
| 6,205,926 | B1 * | 3/2001 | Dufour | 101/492 |
| 6,216,592 | B1 * | 4/2001 | Knauer et al. | 101/247 |
| 6,332,397 | B1 * | 12/2001 | Bolza-Schunemann et al. | 101/183 |
| 6,334,389 | B1 * | 1/2002 | Fischer | 101/216 |
| 6,338,298 | B2 * | 1/2002 | Schneider et al. | 101/179 |
| 6,517,266 | B2 * | 2/2003 | Saund | 400/88 |
| 6,532,872 | B2 * | 3/2003 | Siegl et al. | 101/483 |
| 6,601,505 | B2 * | 8/2003 | Tokiwa | 101/218 |
| 6,634,292 | B2 * | 10/2003 | Fujiwara et al. | 101/141 |
| 6,647,874 | B1 * | 11/2003 | Siegl et al. | 101/211 |
| 6,810,809 | B2 * | 11/2004 | Detmers et al. | 101/483 |
| 6,820,554 | B2 * | 11/2004 | Glockner et al. | 101/485 |
| 6,823,792 | B2 * | 11/2004 | Grutzmacher et al. | 101/483 |
| 6,827,011 | B2 * | 12/2004 | Liebler et al. | 101/177 |
| 6,829,991 | B1 * | 12/2004 | Eaton | 101/217 |
| 6,895,857 | B2 * | 5/2005 | Weschenfelder | 101/216 |
| 6,899,027 | B2 * | 5/2005 | Kersch | 101/228 |
| 7,010,359 | B2 * | 3/2006 | Faulhammer et al. | 700/3 |
| 7,077,061 | B2 * | 7/2006 | Holm et al. | 101/212 |
| 2001/0047733 | A1 * | 12/2001 | Kersch | 101/216 |
| 2002/0023560 | A1 * | 2/2002 | Siegl et al. | 101/248 |
| 2002/0033105 | A1 * | 3/2002 | Charette et al. | 101/220 |
| 2002/0124745 | A1 * | 9/2002 | Pautrat | 101/217 |
| 2004/0050270 | A1 * | 3/2004 | Gerner et al. | 101/216 |
| 2005/0247229 | A1 * | 11/2005 | Hammond et al. | 101/486 |

FOREIGN PATENT DOCUMENTS

| | | | | |
|---|---|---|---|---|
| DE | 2637795 | A1 | | 2/1978 |
| DE | 9117008.7 | U1 | | 8/1993 |
| DE | 19732330 | A1 | | 2/1999 |
| DE | 19951157 | A1 | | 5/2001 |
| DE | 10046376 | A1 | | 4/2002 |
| EP | 0459098 | A1 | | 12/1991 |
| EP | 1 110 729 | A2 | | 6/2001 |
| EP | 1 110 729 | A3 | | 8/2001 |
| FR | 2585523 | A | | 7/1985 |
| GB | 2 024 464 | A | | 1/1980 |
| JP | 62044454 | A | * | 2/1987 |
| JP | 7266548 | A | | 3/1994 |
| JP | 11227166 | A | * | 8/1999 |
| JP | 2001096712 | A | * | 4/2001 |
| JP | 20010288959 | A | | 9/2001 |
| JP | 2003118086 | A | * | 4/2003 |

* cited by examiner

WEB-FED ROTARY PRINTING UNIT

BACKGROUND OF THE INVENTION

Printing units of web fed printing presses, particularly those for newspapers, include printing mechanisms. Each printing mechanism generally consists of a transfer cylinder, a form cylinder, and an inking mechanism as well as a dampening mechanism. Such printing units also can have counter pressure cylinders and one counter pressure cylinder can interact with one or more transfer cylinders of different printing mechanisms.

Printing units also exist that do not have counter pressure cylinders. In such printing units, the transfer cylinders of two printing mechanisms roll off onto each other. Accordingly, a web fed rotary printing unit with several printing mechanisms comprises several form cylinders, as well as several transfer cylinders, and possibly one or more counter pressure cylinders. When the term "cylinder" is used hereinafter, it may refer in the context of the present invention to a form cylinder or a transfer cylinder or a counter pressure cylinder. Also, the term cylinder may refer to cylindrical rollers of an inking mechanism or a dampening mechanism that is involved in the printing.

With typical prior art web fed rotary printing units, each printing mechanism is assigned its own adjustable drive motor to actuate the transfer cylinder and form cylinder, as well as inking and dampening mechanisms of the particular printing mechanism. If a counter pressure cylinder is present, the counter pressure cylinder is also assigned its own drive motor.

With prior art printing units, there is no mechanical drive connection between the printing cylinders actuated by a drive motor. Instead, in the prior art, each of these printing cylinders is controlled in terms of its angular position and/or speed of rotation by its own controller, independently of the other printing cylinders. For this, the angular position, for example, of a printing cylinder is detected by means of a feedback value pick up and its signals are compared with a set point signal, in order to generate a control signal for the particular drive motor that is dependent on the deviation from the set point signal. The particular drive motors are responsible for the synchronization of the printing cylinders of a web fed rotary printing unit. As a result, distortion moments acting within a printing unit may additionally load or relieve the drive motors. For this reason, with prior art arrangements, the drive motors must be designed with very high motor power or torque, which is a disadvantage, particularly from the standpoint of cost.

BRIEF SUMMARY OF THE INVENTION

In view of the foregoing, a general object of the present invention is to provide an improved web fed rotary printing unit.

To this end, a web fed rotary printing unit is provided that includes at least two cylinders, each of which is assigned an adjustable drive motor. The two cylinders are placed in a mechanical drive connection that can be broken and/or made (i.e., disengaged or engaged). When the mechanical drive connection is made, one drive motor of a first cylinder forms a master drive on which a drive motor of at least one second cylinder that is in a mechanical drive connection with the first cylinder depends. This drive motor of the second cylinder can be controlled in the manner of a slave drive.

With the web fed rotary printing unit of the invention, the drive motors are not loaded or relieved by distortion moments that are acting within cylinders or rollers in the mechanical drive connection. Thus, the drive motors can be designed smaller or with less motor power or torque. This produces, among other things, cost benefits for the web fed rotary printing unit of the invention.

Preferably, the drive motor of the first cylinder, i.e., the master drive, is assigned a first controller, which, depending on a deviation between a set point value and a feedback value, regulates the drive motor of the first cylinder. The drive motor of every second cylinder, i.e., every slave drive, is assigned a second controller. When the mechanical drive connection is made, the controller or every second controller regulates the drive motor of the particular second cylinder in dependence on a set point value indicated by the first controller of the master drive. When the mechanical drive connection is broken or opened or not made, the controller or every second controller regulates the drive motor of the particular second cylinder independently of the first controller, yet depending on a deviation between a set point value and a feedback value.

BRIEF DESCRIPTION OF THE SEVERAL VIEWS OF THE DRAWING(S)

DETAILED DESCRIPTION OF THE INVENTION

Figure 1:
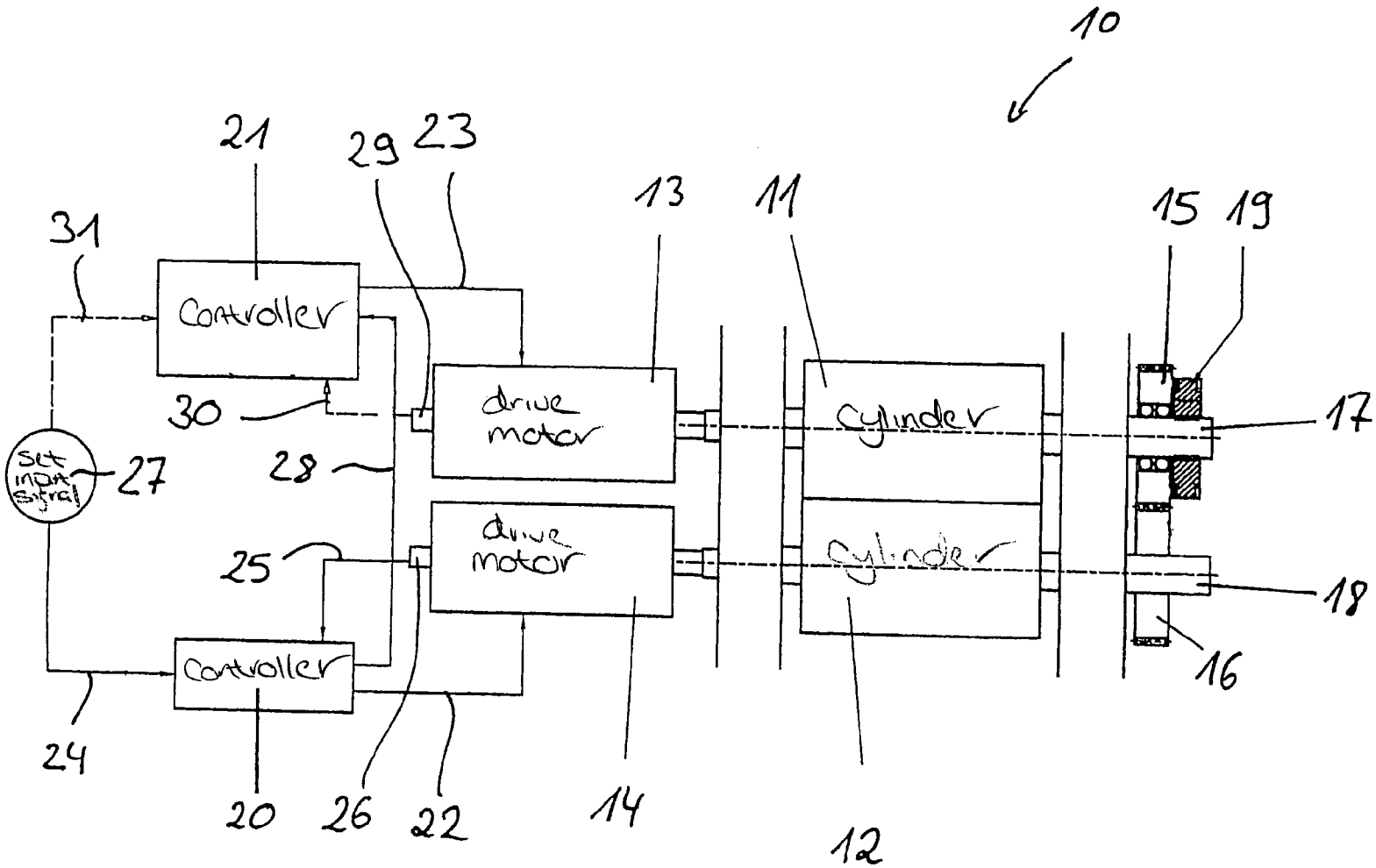
FIG. 1 is a schematic block diagram of an illustrative web fed rotary printing unit of the invention.

Referring now more particularly to FIG. 1 of the drawings, a web fed printing unit according to the invention is shown. The basic principle of a web fed rotary printing unit according to the invention is described with reference to FIG. 1, while FIGS. 2 to 12 show examples of web fed rotary printing units that can be controlled according to the invention.

FIG. 1 illustrates a segment of a web fed rotary printing unit 10 according to the invention in the area of two cylinders 11 and 12. Each of the cylinders 11 and 12 shown in FIG. 1 is assigned a drive motor 13 and 14, respectively. The two cylinders 11, 12 illustrated in FIG. 1 are in a mechanical drive connection. The mechanical drive connection is produced between the two cylinders 11 and 12 via connection gears 15 and 16. The connection gears 15 and 16 are mounted on axles 17 and 18 of the cylinders 11 and 12, with the connection gear 16 being placed firmly on the axle 18 of the cylinder 12 and with the connection gear 15 of the cylinder 11 mounted loosely or displaceably on the axle 17. Through a coupling 19, likewise mounted on the shaft 17 of the cylinder 11, the connection gear 15 can be shifted on the axle 17 and thereby the mechanical drive connection between the two cylinders 11 and 12 can be made or engaged and unmade or disengaged. As will be understood by those skilled in the art, the coupling connection gear can also be positioned on the axle 18 and the noncoupling connection gear on the axle 17. It is only necessary that the mechanical drive connection between the two cylinders 11 and 12 can be made and unmade via the connection gears 15 and 16.

One controller 20 or 21 is assigned to each of the adjustable drive motors 13 and 14 of the cylinders 11 and 12. As can be seen from FIG. 1, the controller 20 assigned to the drive motor 14 provides a control signal 22 for the drive motor 14 and the controller 21 assigned to the drive motor 13 provides a control signal 23 for the drive motor 13.

In accordance with the present invention, the drive control of one of the cylinders in a mechanical drive connection can form a master drive and the drive control of the other cylinder is dependent on the master. Accordingly, the drive control of one of the drive motors forms a master drive in dependence on which the drive control of the other drive motors or the drive motors of the other cylinders can be controlled in the manner of a slave drive.

In the exemplary embodiment of FIG. 1, the drive motor 14 assigned to the cylinder 12 is configured as a master or command drive, which is regulated by the controller 20. The controller 20 of the drive motor 14 generates the control signal 22 for the drive motor 14 as a function of a deviation between a set point value 24 and a feedback value 25 of the drive motor 14. The feedback value 25 is furnished via a feedback pickup 26 and the set point value 24 via a set point signal 27. The controller 20 is fashioned as a position controller and/or speed controller, so that the drive motor 14 forming the master drive is regulated in position and/or speed by the controller 20.

In the embodiment illustrated in FIG. 1, when the mechanical drive connection is made between the two cylinders 11 and 12, the drive motor 14 forms the master drive on which the drive motor 13 depends so as to be regulated in the manner of a slave drive. The control signal 23 for the drive motor 13 is furnished by the controller 21, such that when the mechanical drive connection is made, the controller 20 assigned to the master drive 14 generates a set point value 28 for the controller 21, so as to regulate the drive motor 13 as a slave drive dependent on the drive motor 14 when the mechanical drive coupling is engaged. The controller 21 is configured as a torque controller or a position or speed controller, so that the drive motor 13 is regulated via either its torque or its position or speed.

As shown in FIG. 1, not only is a feedback value pickup 26 assigned to the drive motor 14 serving as the master drive when the mechanical drive connection is made, a feedback value pickup 29 is also assigned to the drive motor 13. The feedback value pickup 29 conveys a corresponding feedback value 30 to the controller 21 assigned to the drive motor 13. This feedback value 30 is needed only for the regulating process when the mechanical drive connection of the two cylinders 11 and 12 is disengaged or open or not made and the regulation of the drive motor 13 is to take place independently of the regulation of the drive motor 14. In this case, a corresponding set point value 31 is then supplied to the controller 21 of the drive motor 13 from the set point signal 27.

Accordingly, as regards cylinders of a web fed rotary printing unit in a mechanical drive connection that can be made and unmade and to each of which an adjustable drive motor is assigned, an aspect of the invention is to provide one drive motor of a cylinder as the master drive on which the drive motor of at least one other cylinder depends so it can be regulated as a slave drive. If the mechanical drive connection is broken, all drive motors can be regulated independently of each other.

In the embodiment of FIG. 1, the mechanical drive connection between the two cylinders 11 and 12 ensures the synchronous angular position and/or the synchronous speed of rotation of the cylinder 11. When the mechanical drive connection is made, the drive motor 13 assigned to the cylinder 11 is governed depending on the drive motor 14 assigned to the cylinder 12. When the mechanical drive connection is made between the two cylinders 11 and 12, the drive motor 14 of the cylinder 12 is preferably governed via its position and the drive motor 13 assigned to the cylinder 11 is preferably governed either via its torque or its speed of rotation. In the case of torque governing of the drive motor 13, a speed limitation is preferably imposed on the torque governing so that, for example, breaking of both cylinders 11 and 12 can be carried out in a defined manner when the mechanical drive connection is broken due to excessive load.

In the case of speed governing of the drive motor 13 assigned to the cylinder 11, a torque limitation is preferably imposed on the speed governing, so that again a definite braking of the two cylinders 11 and 12 is made possible upon opening of the mechanical drive connection. If, for example, the mechanical drive connection between the two cylinders 11 and 12 via the coupling 19 is broken or detached on account of an excessive load, the two drive motors 13 and 14 will be governed independently of each other. Additionally, if the controller 21 is governing via torque when the mechanical drive connection is made, the controller will switch to position or speed governing when the coupling 19 is opened. If the controller 21 is governing via speed when the mechanical drive connection is made, the controller can be switched to position governing when the coupling 19 is opened. However, the controller 21 can also continue to provide speed governing. When the coupling 19 is closed to restore the mechanical drive connection between the two cylinders 11 and 12, the switching can occur in the opposite direction. The opening and closing of the coupling 19 to break or make the mechanical drive connection can occur either when the cylinders 11 and 12 are stationary or rotating.

Figure 2:
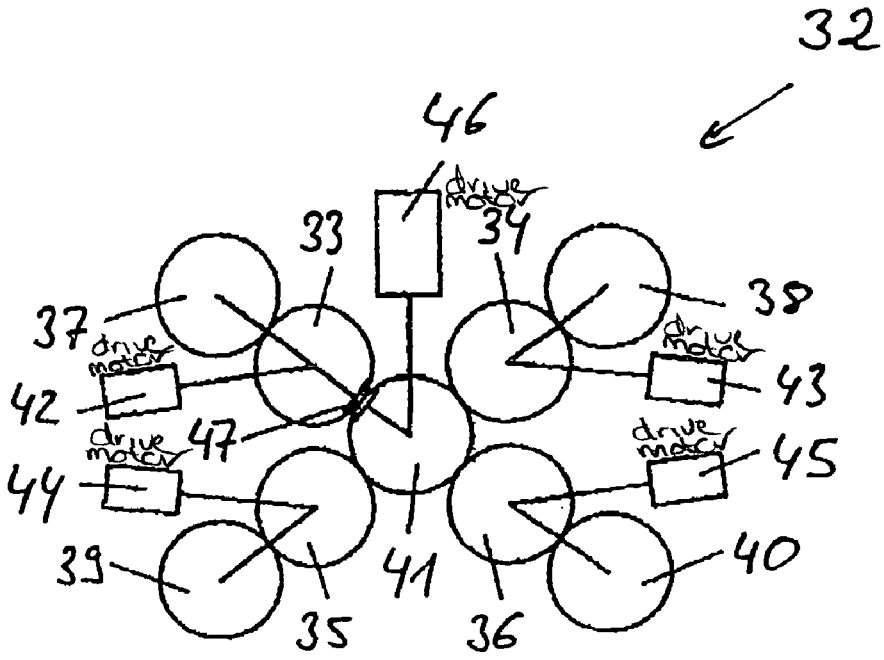
FIG. 2 is a schematic view of a first embodiment a web fed rotary printing unit that can be controlled according to the invention.

FIG. 2 illustrates a first embodiment of a web fed rotary printing unit 32 which can be regulated by the basic principle of the invention. The embodiment of FIG. 2 is configured as a nine-cylinder printing unit. The web fed rotary printing unit 32 has four printing mechanisms. Each of the four printing mechanisms has a transfer cylinder 33, 34, 35, 36 and a form cylinder 37, 38, 39, 40. The transfer cylinders 33-36 of all the printing mechanisms interact with a counter-pressure cylinder 41. Each printing mechanism is assigned its own drive motor 42, 43, 44, 45. The drive motors 42-45 of the illustrated printing mechanisms directly or indirectly drive the transfer cylinders 33-36, and the respective form cylinders 37-40 as well as rollers of inking and dampening mechanisms (not shown) are mechanically entrained by the transfer cylinders 33 36 via gears. The drive motors 42-45, unlike what is shown in FIG. 2, can of course drive the form cylinders 37-40. The drive motors 42-45 can also drive the inking and dampening mechanisms (not shown). In FIG. 2, the counter-pressure cylinder 41 is also assigned its own drive motor 46.

Each of the drive motors 42-46 is assigned its own controller, which can govern the angular position and/or the speed of the drive motor and, accordingly, that of the corresponding printing mechanism by a comparison between a feedback value and a set point value. In the embodiment illustrated in FIG. 2, a mechanical drive connection that can be made and unmade with the help of a coupling 47 exists between the counter-pressure cylinder 41 and the transfer cylinder 33. For example, in a setup operation, the mechanical drive connection is broken, so that each cylinder can be turned or operated independently by its corresponding drive motor. When the mechanical drive connection is made between the counter-pressure cylinder 41 and the transfer cylinder 33, the drive motor 46 assigned to the counter-pressure cylinder 41 can now be governed in dependence on the mechanically connected, preferably position governed drive motor 42 of the transfer cylinder 33 in accordance with the invention. In this case, the drive motor 42 forms a master drive for the drive motor 46 of the counter-pressure cylinder 41, which is governed in the manner of a slave drive. The governing of the two drive motors 42 and 46 can occur as described above with regard to FIG. 1, where the counter-pressure cylinder 41 corresponds to the cylinder 11, the transfer cylinder 33 to the cylinder 12, the drive motor 46 to the drive motor 13 and the drive motor 42 to the drive motor 14.

If a paper web is to be taken during printing through two nine-cylinder printing units in the same direction (as described in connection with FIG. 2), in order to imprint the paper web in 4/0 mode in alternation each time without having to pause the web fed rotary press, then the counter-pressure cylinder of the nine-cylinder printing unit that is in the so-called setup mode (i.e. with the mechanical drive connection opened or broken between the counter-pressure cylinder and the transfer cylinder) will preferably be independently speed or position governed. The corresponding transfer cylinders in this case have no line contact with the counter-pressure cylinder (i.e., the printing units are in the so-called print off position) and the counter-pressure cylinder serves merely as a paper guide roller.

On the other hand, the mechanical drive connection is made between the counter-pressure cylinder and the corresponding transfer cylinder of the currently working printing unit. In this printing unit, the corresponding drive motors will be governed as described in detail with regard to FIG. 1, i.e. one drive motor forms a position governed master drive and the drive motor in the mechanical drive connection with this master drive is either torque governed or position or speed governed in dependence on the master drive in the manner of a slave drive. The corresponding transfer cylinders have line contact with the counter-pressure cylinder (i.e., the printing mechanisms are in the so called print on position).

In case of a production change, the printing units of the newly set up web fed rotary printing unit are accelerated to production speed and synchronized in the print off position. When the transfer cylinder and the counter-pressure cylinder are turning synchronously (and possibly in correct position), the mechanical drive connection between the counter-pressure cylinder and the corresponding transfer cylinder is made. The drive motor of the counter-pressure cylinder then switches, which was until now still independently governed in its position or speed, to torque governing or position or speed governing dependent on the now mechanically connected master motor of the transfer cylinder. Speed limiting or torque limiting can additionally be imposed. The transfer cylinders of the previously inactive printing unit swing into the print on position, the transfer cylinders of the active printing unit swing into the print off position (i.e., the previously inactive printing unit becomes the active printing unit and the previously active printing unit becomes the inactive printing unit). The mechanical drive connection between the counter-pressure cylinder and the corresponding transfer cylinder of the now inactive printing unit is opened, and the drive motor previously defined as the slave drive is switched to independent position governing or speed governing. The now inactive web fed rotary printing unit is halted in the print off position, so that a reoutfitting can subsequently occur and the corresponding counter-pressure cylinder for its part now takes on the function of a paper guide roller.

In connection with FIG. 2, it will be understood by those skilled in the art that, within a mechanically connected drive train with several drive motors, the choice as to which of the drive motors will be the master drive and which of the drive motors will be the slave drive is left free. Thus, for example, in the embodiment illustrated in FIG. 2, the drive motor 46 of the counter-pressure cylinder 41 can be governed instead of the drive motor 42 by a comparison of feedback values and set point values, in which case a corresponding feedback pickup is assigned to either the drive motor 46 or the counter-pressure cylinder 41. The drive motor 42 of the transfer cylinder 33 in a mechanical drive connection with the counter-pressure cylinder 41 is then either torque governed or position or speed governed in dependence on the preferably position governed drive motor 46 of the counter-pressure cylinder 41, as described in detail with regard to FIG. 1. In this case, the counter-pressure cylinder 41 corresponds to the cylinder 12 and the transfer cylinder 33 to the cylinder 11 of FIG. 1.

With regard to the web fed rotary printing unit 32 of FIG. 2, the mechanical drive connection between the counter-pressure cylinder 41 and the transfer cylinder 33 preferably occurs with the transfer cylinder of the printing mechanism that prints the color black, since this printing mechanism is generally needed during the entire printing process. If, however, as an exception, the printing mechanism printing the color black is not needed, such as if printing is being done with the remaining printing mechanisms in 1/0, 2/0 or 3/0 print mode, it is possible to actuate the printing mechanism for the color black in a so-called print off position. In this case, it is possible to have one or more couplings within the drive train of the printing mechanism that prints the color black so that unneeded rollers, such as those in the inking mechanism and/or dampening mechanism, can be disengaged.

Figure 3:
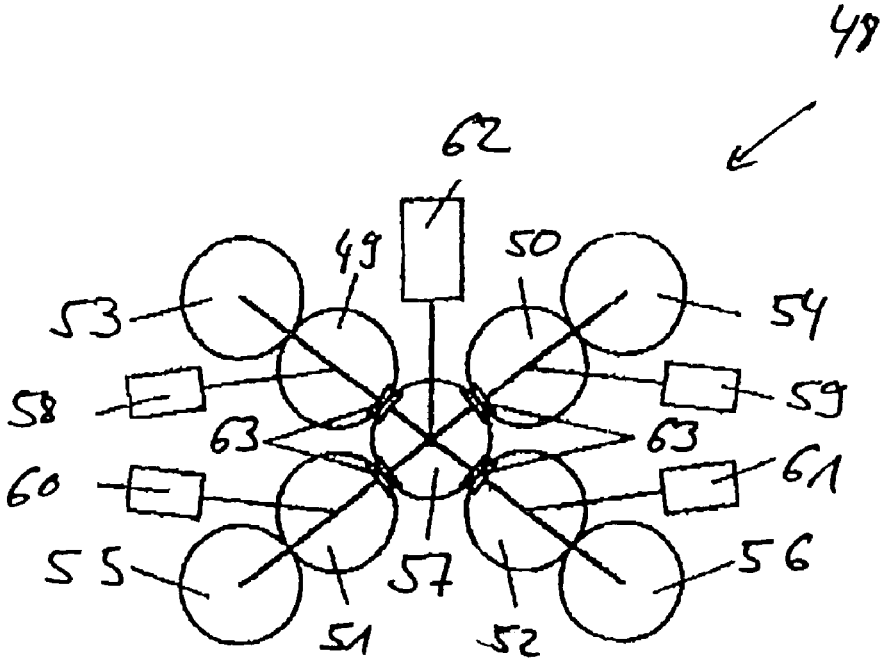
FIG. 3 is a schematic view of a second embodiment of a web fed rotary printing unit that can be controlled according to the invention.

FIG. 3 shows another embodiment of a web fed rotary printing unit 48 that can be governed in accordance with the present invention. In the FIG. 3 embodiment, the web fed rotary printing unit 48 is once again configured as a nine-cylinder printing unit with four printing mechanisms. Each printing mechanism consists of a transfer cylinder 49, 50, 51, 52, a form cylinder 53, 54, 55, 56 and of a counter-pressure cylinder 57 that cooperates with all transfer cylinders 49-52 of all the printing mechanisms. Each of the transfer cylinders 49-52 is again assigned a separate, adjustable drive motor 58, 59, 60, 61, and the counter-pressure cylinder 57 is also assigned its own drive motor 62. In the embodiment illustrated in FIG. 3, the counter-pressure cylinder 57 stands in mechanical drive connection with all transfer cylinders 49-52, and the mechanical drive connections between the transfer cylinders 49-52 and the counter-pressure cylinder 57 can be made or unmade via couplings 63. In the FIG. 3 embodiment, the drive motor 62 of the counter-pressure cylinder 57 forms the master drive in accordance with the present invention, while the drive motors 58-61 of all the transfer cylinders 49-52 are either torque governed or position or speed governed in dependence on the preferably position governed drive motor 62 of the counter-pressure cylinder 57 in the form and manner described in detail with reference to FIG. 1. In this case, the counter-pressure cylinder 57 corresponds to the cylinder 12 of FIG. 1, the transfer cylinders 49-52 each correspond to a cylinder 11, the drive motor 62 corresponds to the drive motor 14 and the drive motors 58-61 each correspond to a drive motor 13.

Figure 4:
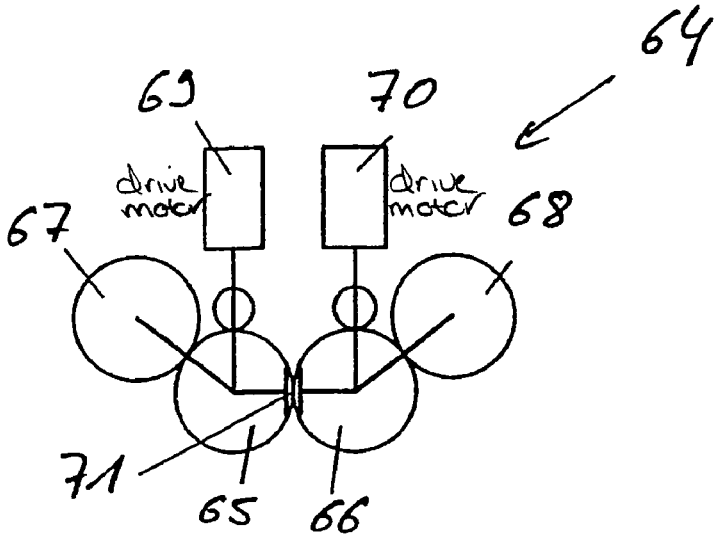
FIG. 4 is a schematic view of a third embodiment of a web fed rotary printing unit that can be controlled according to the invention.

The present invention is not limited to use in web fed rotary printing units with counter-pressure cylinders, but rather the principle of the invented master/slave drive can also be used for two adjacent transfer cylinders or between a transfer cylinder and a form cylinder. Thus, FIG. 4 illustrates a web fed rotary printing unit 64 with two printing mechanisms, each printing mechanism having a transfer cylinder 65 or 66 and a form cylinder 67 or 68. Each of the transfer cylinders 65 and 66 is assigned a drive motor 69 or 70, while the two transfer cylinders 65 and 66 interact when printing and stand in a mechanical drive connection that can be made and unmade with the help of a coupling 71. In the FIG. 4 embodiment, either the drive motor 69 of the transfer cylinder 65 forms the master drive for the drive motor 70 or the drive motor 70 of the transfer cylinder 66 forms the master drive for the drive motor 69 of the transfer cylinder 65.

Figure 5:
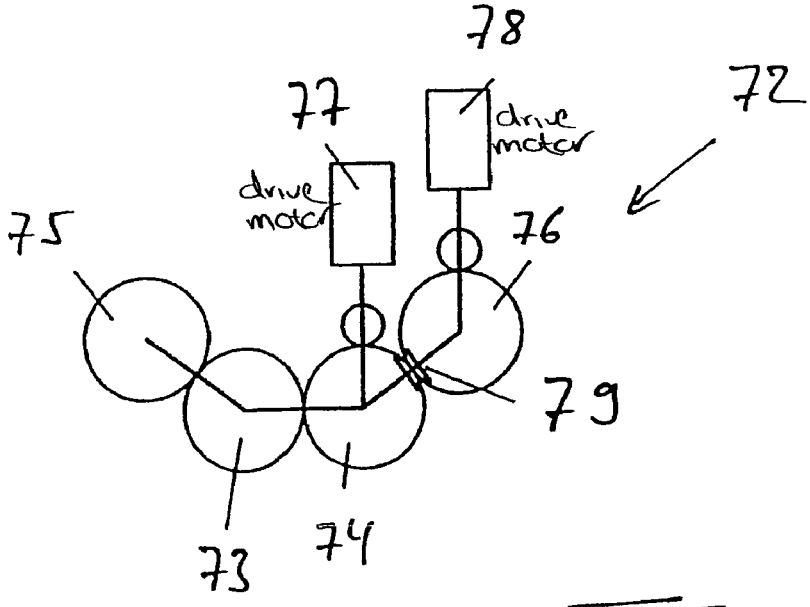
FIG. 5 is a schematic view of a fourth embodiment of a web fed rotary printing unit that can be controlled according to the invention.

FIG. 5 illustrates a web fed rotary printing unit 72 which, like the web fed rotary printing unit 64 of FIG. 4, has two printing mechanisms, each with a transfer cylinder 73 or 74 and a form cylinder 75 or 76. In the FIG. 5 embodiment, the transfer cylinder 74 is assigned a drive motor 77, which actuates the transfer cylinder 74 and furthermore the transfer cylinder 73 and the form cylinder 75. The form cylinder 75 is assigned a separate drive motor 78. The transfer cylinder 74 and the form cylinder 76 stand in a mechanical drive connection which can be made and unmade via a coupling 79. In the embodiment of FIG. 5, either the drive motor 78 of the form cylinder 76 forms the master drive of the drive motor 77 of the transfer cylinder 74 or the drive motor 77 of the transfer cylinder 74 forms the master drive for the drive motor 78 of the form cylinder 76. The details of the master/slave drive control are the same as those provided in relation to FIG. 1.

Figure 6:
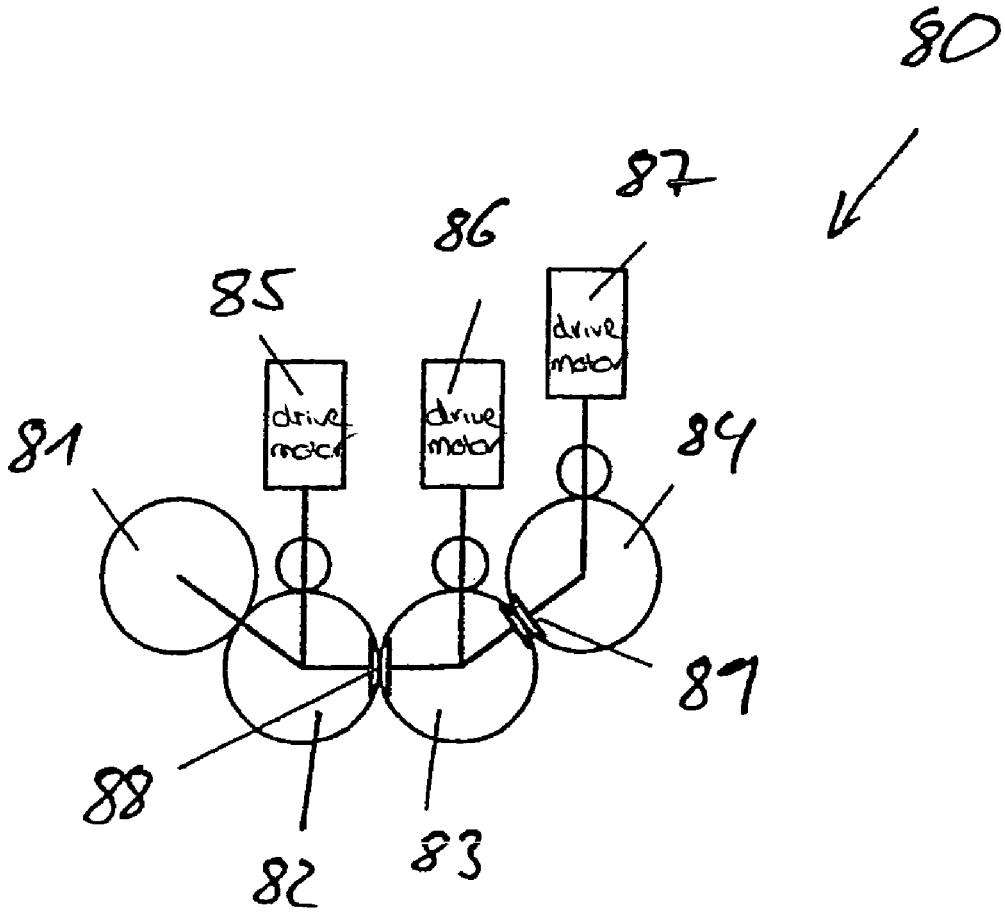
FIG. 6 is a schematic view of another embodiment of a web fed rotary printing unit that can be controlled according to the invention.
Figure 7:
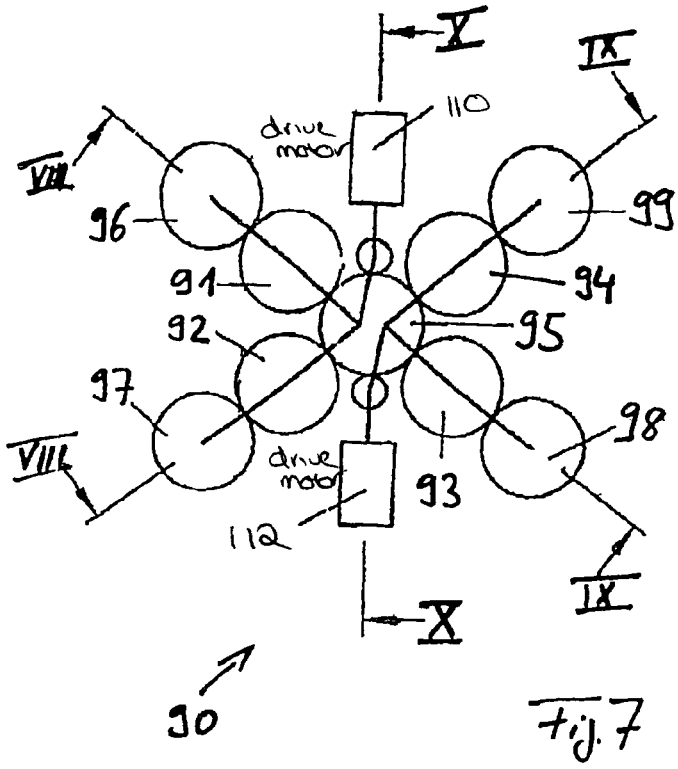
FIG. 7 is a schematic view of another embodiment of a web fed rotary printing unit that can be controlled according to the invention.
Figure 8:
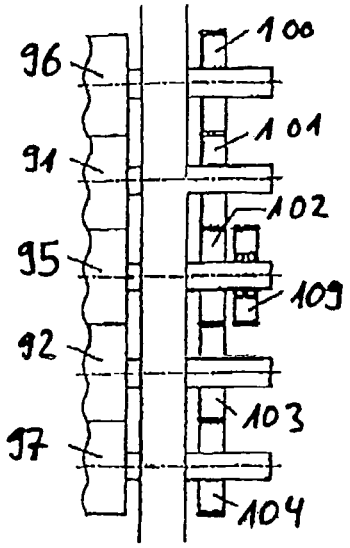
FIG. 8 is a cross sectional view of the web fed rotary printing unit of FIG. 7 taken in the plane of line VIII-VIII in FIG. 7.

As shown by FIG. 6, the invention can also be used when several mechanically interconnected slave drives are present. FIG. 6 shows a web fed rotary printing unit 80 with four cylinders 81, 82, 83, 84 involved in the printing. The cylinders 82, 83, 84 are each assigned their own adjustable drive motor 85, 86, 87, while the drive motor 85 assigned to the cylinder 82 also actuates the cylinder 81. The cylinder 82 stands with the cylinder 83 and the cylinder 83 stands with the cylinder 84 in a mechanical drive connection that can be made and unmade by means of a coupling 88 or 89, respectively. In the embodiment of FIG. 6, the drive motor 85 assigned to the cylinder 82 can form a master drive for the drive motors 86 and 87, which are then governed in the sense of a slave drive according to the present invention when the mechanical drive connection is made. Accordingly, in the example embodiment of FIG. 6, there are two slave drives that are mechanically connected in series.

Figure 9:
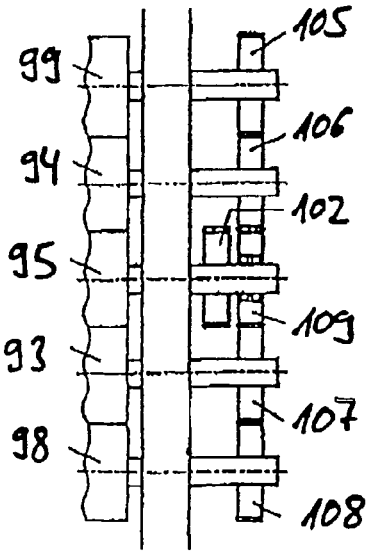
FIG. 9 is a cross sectional view of the web fed rotary printing unit of FIG. 7 taken in the plane of line IX-IX in FIG. 7.

Another variant of a web fed rotary printing unit 90 (configured as a nine-cylinder printing unit) that can be governed in the manner of the present invention, is shown in FIGS. 7 through 10. Here, again, four transfer cylinders 91, 92, 93, 94 are in contact with a common counter-pressure cylinder 95. Against each of the transfer cylinders 91-94 lies a form cylinder 96, 97, 98, 99. As can be seen from FIG. 8, a connection gear 100, 101, 102, 103, 104 is firmly mounted on the axle of each cylinder 96, 91, 95, 92, 97. These gears lie in a common plane and engage with each other. FIG. 9 shows that a connection gear 105, 106, 107, 108 is firmly mounted on the cylinders 99, 94, 93, 98. These gears are arranged in a plane displaced laterally with respect to the connection gears 100-104. The connection gears 106, 107 engage with another connection gear 109 loosely mounted on the axle of the counter-pressure cylinder 95.

Figure 10:
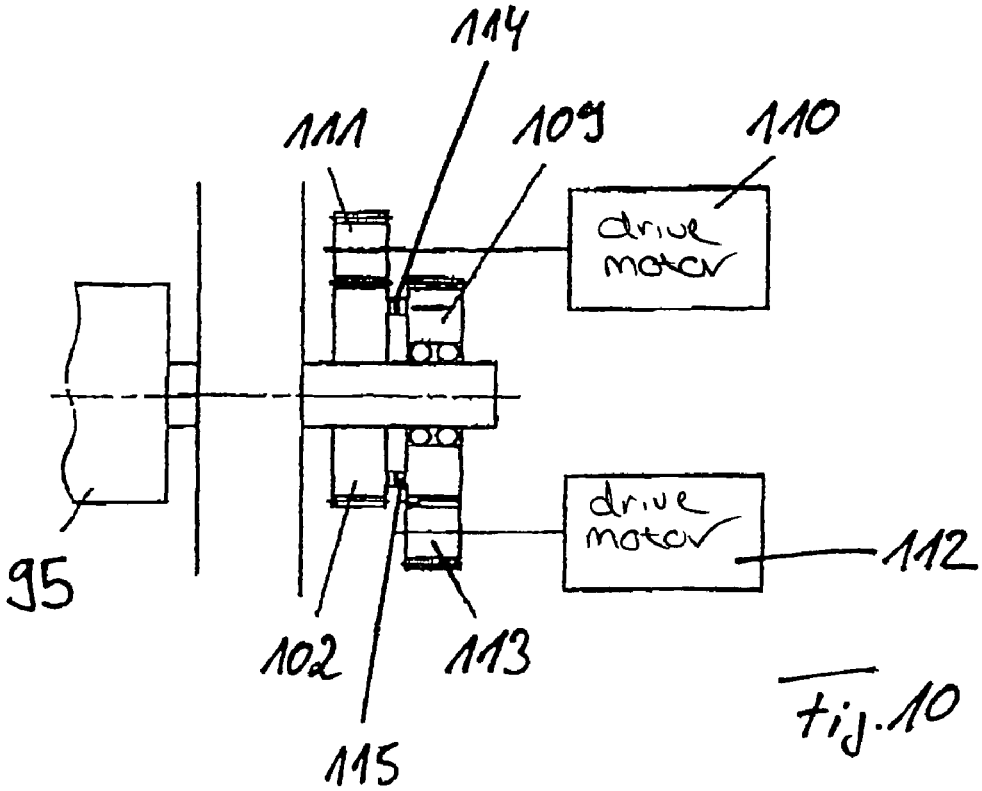
FIG. 10 is a cross sectional view of the web fed rotary printing unit of FIG. 7 taken in the plane of line X-X in FIG. 7.

As shown in FIG. 10, a drive motor 110 actuates the connection gear 102, which is firmly mounted on the shaft of the counter-pressure cylinder 95, by a transmission chain 111 (shown schematically). Another drive motor 112 actuates, via a schematically indicated transmission chain 113, the connection gear 109, loosely mounted on the axle of the counter-pressure cylinder 95. The transmission chains 111 and 113 can be formed by several gears engaging with each other or by belt or chain drives. In this arrangement, the two printing mechanisms are actuated together with the transfer cylinders 91, 92 by means of the drive motor 110, while the cylinders 93, 98, 94, 99 can be halted. By turning on the drive motor 112, all the printing mechanisms of this printing unit 90 can be printing. As further shown in FIG. 10, the connection gear 109 can be coupled to the counter-pressure cylinder 95. The coupling is depicted schematically when the connection gear 109 is axially movable and has coupling elements 114 that come into engagement with mating coupling elements 115 on the connection gear 102 on the axle of the counter-pressure cylinder 95 by axial displacement. In variations of the arrangement of FIGS. 7 through 10, the drive motor 110, for example, can form the master drive and the drive motor 112 the slave drive in the meaning of the present invention.

Figure 11:
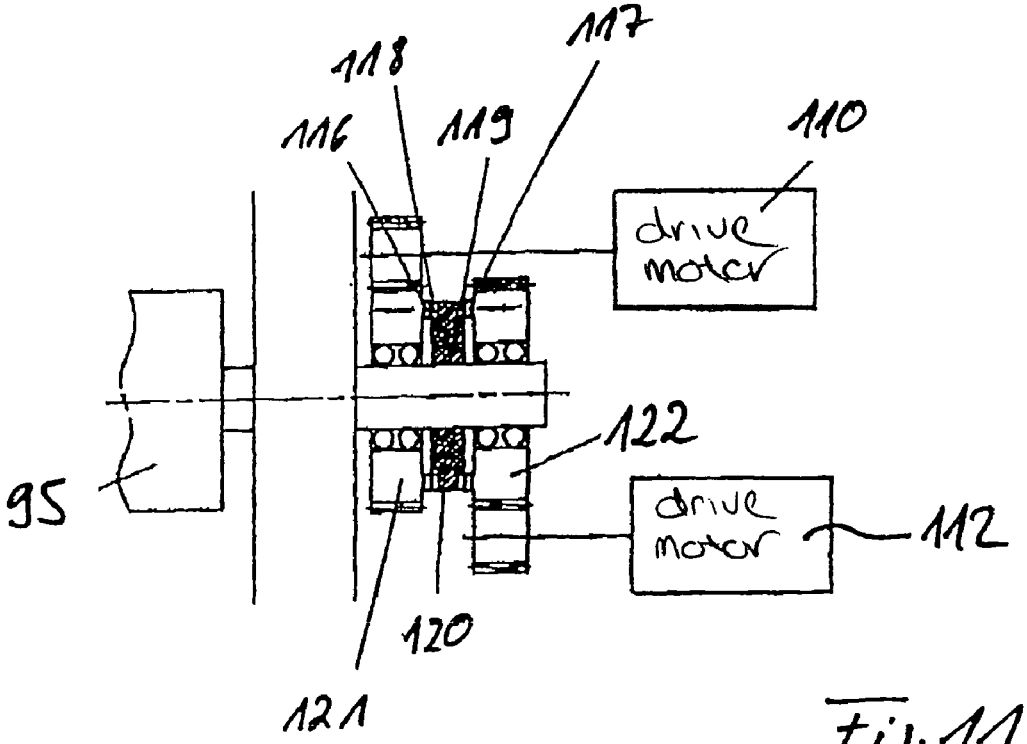
FIG. 11 is a cross sectional view showing an alternative arrangement of the web fed rotary printing unit shown in FIG. 10.

One variant to the arrangement of FIG. 10 is shown in FIG. 11. In the FIG. 11 arrangement, the counter-pressure cylinder 95 can be uncoupled from the drive motor 110 and/or 112 and thus from the printing units assigned to it. With this arrangement, it is possible for the counter-pressure cylinder 95 to remain stationary while the printing mechanisms are being turned by the motors 110 and/or 112. This may be necessary, for example, when the printing mechanisms are being set up and the counter-pressure cylinder 95 already has a paper web pulled in and wrapped around it. In FIG. 11, the coupling 116, 117, 118, 119 is schematically depicted such that a coupling disk 120 is firmly seated on the axle of the counter-pressure cylinder 95. A connection gear 121, 122 that is free-turning and can shift axially on the axle of the counter-pressure cylinder 95 is on either side of the coupling disk 120. The connection gear 121, in turn, meshes with the connection gears 101, 103, and the connection gear 122 with the connection gears 106, 107. The connection gears 121, 122 have coupling elements 116, 117 on their side facing the coupling disk 120, which can optionally be brought into engagement with mating coupling elements 118, 119 of the coupling disk 120 by an axial shifting of the gears 121, 122. Also in the variant of FIG. 11 the drive motor 110 can form the master drive and the drive motor 112 the slave drive according to the present invention.

Figure 12:
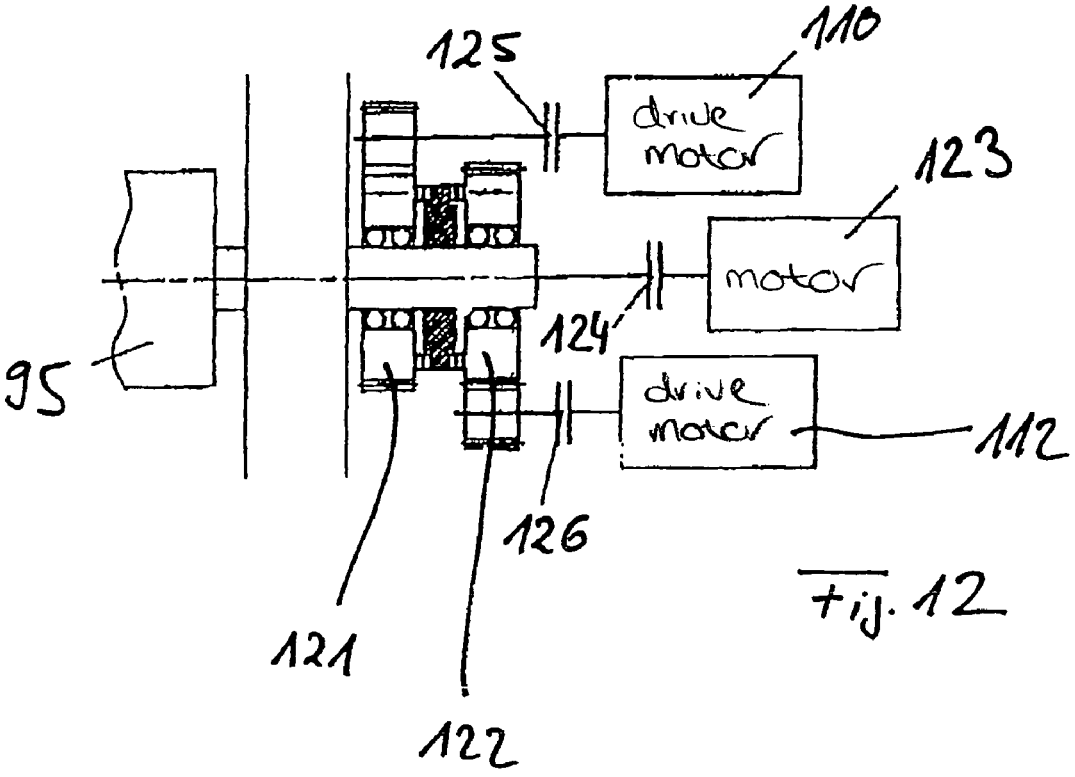
FIG. 12 is a cross sectional view showing another alternative arrangement of the web fed rotary printing unit shown in FIG. 10.

Another alternative to the arrangements of FIGS. 10 and 11 is shown in FIG. 12. According to FIG. 12, the counter-pressure cylinder 95 can be actuated by another motor 123. A separating coupling 124 can be connected between this motor 123 and the counter-pressure cylinder 95. As shown in FIG. 12, separating couplings 125 and 126 can also be connected in series with the motors 110 and 112, respectively. In this variant, it is possible that, while the printing mechanisms are being turned by their assigned motors 110, 112, the counter-pressure cylinder 95 is being turned by its assigned motor 123. This may be required, for example, when a paper web is being pulled through the printing unit, while the counter-pressure cylinder 95 is being actuated with the motor 123, and at the same time the printing mechanisms with their assigned motors 110 and 112 are being set up.

The motor 123 can be a drive motor, which likewise actuates the printing unit during the printing operation. In this case, the separation coupling 124 is closed or is not needed. But the motor 123 can also be purely an auxiliary motor that is disengaged by the separation coupling 124 during the printing operation. For example, the motor 123 can be mounted on the axle of the transfer cylinder 95 or connected to the axle rigidly or via a coupling 124. But it can also actuate the counter-pressure cylinder via a transmission chain, for example, via a gear firmly connected to the counter-pressure cylinder or by a belt or chain drive. In the embodiment of FIG. 12, the motor 123 can form a master drive for the motors 110 and 112 which function as slave drives. It is also conceivable that the motor 110, for example, forms the master drive, while the motor 112 forms a slave drive and the motor 123 forms another slave drive or an independent drive for setup mode.

Many additional variations or modifications of web fed rotary printing units making use of the master/slave drive concept of the invention are conceivable. Thus, with respect to the present invention, the master/slave drive concept can conceivably be employed between a form cylinder and a cylinder or roller of an inking mechanism or a dampening mechanism. Furthermore, the master/slave drive concept can also be implemented between an inking mechanism and a dampening mechanism.

With the present invention, several cylinders can be connected to the drive motor working or serving as the master drive, for example, a counter-pressure cylinder, a transfer cylinder and/or form cylinder. Likewise, the master drive can be connected to an inking mechanism and/or dampening mechanism. It is also possible to mechanically connect several counter-pressure cylinders, several transfer cylinders and/or several form cylinders to the master drive. As with the master drive, it is possible to mechanically connect several cylinders or rollers involved in the printing process with the slave drive.

Regarding other drive arrangements or systems in which the master/slave drive concept of the present invention can be used, reference is made to commonly assigned patent application DE 10 2004 003 339 (corresponding U.S. application Ser. No. 11/003,859 filed Dec. 3, 2004), the disclosures of which are incorporated herein by reference. In particular, the invention can also be implemented in the drive arrangements or systems shown in FIGS. 4*a*, 5*a*, 6*a* and 7*a* in conjunction with FIGS. 8, 8*a*, 9 and 19, and also per FIGS. 10 and 11 of DE 10 2004 003 339.

LIST OF REFERENCE NUMBERS

10 Web fed rotary printing unit
11 Cylinder
12 Cylinder
13 Drive motor
14 Drive motor
15 Connection gear
16 Connection gear
17 Axle
18 Axle
19 Coupling
20 Controller
21 Controller
22 Control signal
23 Control signal
24 Setpoint value
25 Feedback value
26 Feedback value pickup
27 Setpoint signal
28 Setpoint value
29 Feedback value pickup
30 Feedback value
31 Setpoint value
32 Web fed rotary printing unit
33 Transfer cylinder
34 Transfer cylinder
35 Transfer cylinder
36 Transfer cylinder
37 Form cylinder
38 Form cylinder
39 Form cylinder
40 Form cylinder
41 Counter-pressure cylinder
42 Drive motor
43 Drive motor
44 Drive motor
45 Drive motor
46 Drive motor
47 Coupling
48 Web fed rotary printing unit
49 Transfer cylinder
50 Transfer cylinder
51 Transfer cylinder
52 Transfer cylinder
53 Form cylinder
54 Form cylinder
55 Form cylinder
56 Form cylinder
57 Counter-pressure cylinder
58 Drive motor
59 Drive motor
60 Drive motor
61 Drive motor
62 Drive motor
63 Coupling
64 Web fed rotary printing unit
65 Transfer cylinder
66 Transfer cylinder
67 Form cylinder
68 Form cylinder
69 Drive motor
70 Drive motor
71 Coupling
72 Web fed rotary printing unit
73 Transfer cylinder
74 Transfer cylinder
75 Form cylinder
76 Form cylinder
77 Drive motor
78 Drive motor
79 Coupling
80 Web fed rotary printing unit
81 Cylinder
82 Cylinder
83 Cylinder
84 Cylinder
85 Drive motor
86 Drive motor
87 Drive motor

88 Coupling
89 Coupling
90 Web fed rotary printing unit
91 Transfer cylinder
92 Transfer cylinder
93 Transfer cylinder
94 Transfer cylinder
95 Counter-pressure cylinder
96 Form cylinder
97 Form cylinder
98 Form cylinder
99 Form cylinder
100 Connection gear
101 Connection gear
102 Connection gear
103 Connection gear
104 Connection gear
105 Connection gear
106 Connection gear
107 Connection gear
108 Connection gear
109 Connection gear
110 Drive motor
111 Transmission chain
112 Drive motor
113 Transmission chain
114 Coupling element
115 Coupling element
116 Coupling element
117 Coupling element
118 Mating coupling element
119 Mating coupling element
120 Coupling disk
121 Connection gear
122 Connection gear
123 Drive motor
124 Separation coupling
125 Separation coupling
126 Separation coupling

The invention claimed is:

1. A web fed rotary printing unit comprising a plurality of cylinders including a first cylinder assigned a first adjustable drive motor and a second cylinder assigned a second adjustable drive motor, the first and second cylinders of the printing unit each consisting of a cylinder from the group consisting of a form cylinder, a transfer cylinder, a counter pressure cylinder, an inking mechanism roller or a dampening mechanism roller, a mechanical drive connection between the first and second cylinders that is movable between an engaged position and a disengaged position, wherein when the mechanical drive connection is in the engaged position the first drive motor is operable as a master drive and the second drive motor is controllable as a slave drive that depends on the first drive motor and when the mechanical drive connection is in the disengaged position the first drive motor drives the first cylinder and the second drive motor drives the second cylinder and the first and second drive motors are controllable independently.

2. The web fed rotary printing unit according to claim 1, wherein the first drive motor of the first cylinder has an associated first controller that regulates the first drive motor depending on a deviation between a set point value and a feedback value.

3. The web fed rotary printing unit according to claim 2, wherein the first controller is configured as a position governor or speed governor.

4. The web fed rotary printing unit according claim 2, wherein the second drive motor has an associated second controller.

5. The web fed rotary printing unit according to claim 4, wherein the second controller governs the second drive motor of the second cylinder depending on a set point value assigned by the first controller of the first drive motor master drive when the mechanical drive connection is in the engaged position.

6. The web fed rotary printing unit according to claim 4, wherein the second controller governs the second drive motor of the second cylinder depending on a deviation between a set point value and a feedback value of the respective second cylinder when the mechanical drive connection is in the disengaged position.

7. The web fed rotary printing unit according to claim 4, wherein when the mechanical drive connection is in the engaged position the first controller assigned to the first drive motor governs the first drive motor via position and the second controller governs the second drive motor in dependence on the first controller, and wherein when the mechanical drive connection is in the disengaged position the second controller governs the second drive motor independently of the first controller.

8. The web fed rotary printing unit according to claim 7, wherein the second controller is operable via torque governing when the mechanical drive connection is in the engaged position and the second controller is switchable to position governing or speed governing when the mechanical drive connection is in the disengaged position.

9. The web fed rotary printing unit according to claim 7, wherein the second controller is operable via speed governing when the mechanical drive connection is in the engaged position and the second controller can remain operating via speed governing or is selectively switchable to position governing when the mechanical drive connection is in the disengaged position.

10. The web fed rotary printing unit according to claim 7, wherein the second controller is operable via torque governing with a selectively imposed speed limitation.

11. The web fed rotary printing unit according to claim 7, wherein the second controller is operable via a speed governing or position governing with a selectively imposed a torque limitation.

* * * * *